US008875955B2

(12) United States Patent
Arora et al.

(10) Patent No.: US 8,875,955 B2
(45) Date of Patent: Nov. 4, 2014

(54) DUAL-WALLED DISPENSER

(71) Applicant: Conopco, Inc., d/b/a Unilever, Englewood Cliffs, NJ (US)

(72) Inventors: Amit Arora, Leeds (GB); Alex Sandor Szekely, Jackson, NJ (US); Timothy Charles Dzurik, Erie, PA (US); Garen Kouyoumjian, Warwickshire (GB); Amanda Claire Wilding, Leeds (GB)

(73) Assignee: Conopco, Inc., Englewood Cliffs, NJ (US)

( * ) Notice: Subject to any disclaimer, the term of this patent is extended or adjusted under 35 U.S.C. 154(b) by 0 days.

(21) Appl. No.: 13/753,576

(22) Filed: Jan. 30, 2013

(65) Prior Publication Data

US 2013/0193167 A1 Aug. 1, 2013

Related U.S. Application Data

(60) Provisional application No. 61/593,165, filed on Jan. 31, 2012.

(51) Int. Cl.

| | |
|---|---|
| ***B67D 7/60*** | (2010.01) |
| ***A45D 40/04*** | (2006.01) |
| ***B65D 83/00*** | (2006.01) |

(52) U.S. Cl.

CPC ..... *B65D 83/0011* (2013.01); *A45D 40/04* (2013.01); *A45D 2200/055* (2013.01)

USPC ..... 222/390; 222/386; 401/68; 401/75; 401/175

(58) Field of Classification Search

CPC ..... B65D 83/0011; B65D 83/0027; A45D 40/04; A45D 40/16; A45D 40/20; A45D 40/205; A45D 2040/208

USPC ..... 222/390, 386, 326; 401/68, 61, 401/171–172, 174–175, 179, 75

See application file for complete search history.

(56) References Cited

U.S. PATENT DOCUMENTS

| | | | | |
|---|---|---|---|---|
| 531,924 | A | 1/1895 | Gibson | |
| 1,969,331 | A | 8/1934 | Small | |
| 2,022,075 | A | 11/1935 | Cabrera | |
| 2,626,847 | A | 1/1953 | Brown | |
| 3,156,387 | A * | 11/1964 | Harwood | 222/390 |
| 3,205,764 | A | 9/1965 | Letter | |
| 3,815,787 | A * | 6/1974 | Spies | 222/95 |

(Continued)

FOREIGN PATENT DOCUMENTS

| | | | |
|---|---|---|---|
| DE | 3118893 | A1 | 11/1982 |
| DE | 3118893 | A1 | 11/1982 |

(Continued)

OTHER PUBLICATIONS

NiveaTM Invisible Anti-Transpirant, 40 ml pack (2011); photos of cutaway pack (14 photos).

(Continued)

*Primary Examiner* — Frederick C Nicolas
(74) *Attorney, Agent, or Firm* — Karen E. Klumas

(57) ABSTRACT

A dispenser having an inner barrel, outer shell, screw member, platform and control member; the outer shell, screw member and control member having configurations that provides for particular engagement features in the assembled dispenser, including features that compensate for dimensional variation.

16 Claims, 9 Drawing Sheets

(56) References Cited

U.S. PATENT DOCUMENTS

| | | | | |
|---|---|---|---|---|
| 3,837,574 | A | 9/1974 | Curran | |
| 4,139,311 | A | 2/1979 | Lorscheidt | |
| 4,363,560 | A | 12/1982 | Gentile | |
| 4,621,935 | A | 11/1986 | Sussman | |
| 5,240,337 | A | 8/1993 | Gruner | |
| 5,286,126 | A | 2/1994 | Harris | |
| 5,346,323 | A | 9/1994 | Harris | |
| 5,437,513 | A * | 8/1995 | Favre | 401/68 |
| 5,538,161 | A | 7/1996 | Koehler | |
| 5,707,698 | A | 1/1998 | Favre | |
| 5,833,382 | A | 11/1998 | Jenks | |
| 5,902,062 | A | 5/1999 | Rosenblatt | |
| 6,013,270 | A | 1/2000 | Hargraves | |
| 6,039,483 | A | 3/2000 | Szekely | |
| 6,089,774 | A | 7/2000 | Franken | |
| 6,276,857 | B1 | 8/2001 | Szekely | |
| 6,289,982 | B1 * | 9/2001 | Naji | 165/177 |
| D454,229 | S | 3/2002 | Look | |
| 6,592,278 | B1 | 7/2003 | Holthaus | |
| 6,773,190 | B2 | 8/2004 | Matsumoto | |
| 6,817,799 | B1 | 11/2004 | Petit | |
| 6,852,193 | B2 | 2/2005 | Kneafsey | |
| 7,229,611 | B2 | 6/2007 | Zamudio-Tena | |
| 7,389,894 | B2 | 6/2008 | Danne | |
| 7,488,129 | B1 * | 2/2009 | Prischak | 401/98 |
| 8,096,724 | B2 * | 1/2012 | Bolander et al. | 401/194 |
| 8,388,249 | B2 * | 3/2013 | Groh et al. | 401/175 |
| 2003/0108376 | A1 | 6/2003 | Hurlburt | |
| 2004/0206783 | A1 | 10/2004 | Danne | |
| 2005/0100392 | A1 | 5/2005 | Chen | |
| 2007/0110504 | A1 | 5/2007 | Bolander | |
| 2007/0147948 | A1 * | 6/2007 | Murakoshi et al. | 401/175 |
| 2007/0172304 | A1 | 7/2007 | Bolander | |
| 2008/0050168 | A1 | 2/2008 | Groh | |
| 2008/0063616 | A1 | 3/2008 | Walling | |
| 2012/0039655 | A1 * | 2/2012 | Baines et al. | 401/68 |
| 2012/0039656 | A1 * | 2/2012 | Baines et al. | 401/68 |
| 2013/0028649 | A1 | 1/2013 | Kobayashi | |

FOREIGN PATENT DOCUMENTS

| | | | |
|---|---|---|---|
| EP | 0310488 | | 4/1989 |
| EP | 0310488 | A1 | 4/1989 |
| FR | 2556941 | | 6/1985 |
| FR | 2567376 | | 1/1986 |
| FR | 2639260 | | 5/1990 |
| FR | 2796044 | A1 | 1/2001 |
| GB | 467410 | | 6/1937 |
| GB | 1215725 | | 12/1970 |
| GB | 2137954 | A | 10/1984 |
| WO | WO2011151873 | A1 | 12/2011 |

OTHER PUBLICATIONS

Co-pending Application: Aplicant: Bicknell et al., U.S. Appl. No. 29/427,538, filed Jul. 19, 2012.

Co-pending Application: Applicant: Bicknell et al., U.S. Appl. No. 29/427,539, filed Jul. 19, 2012.

Photos (3) of Nivea Invisble Deodorant 40 ml Beiersdorf 40 ml (2010).

Photo of P&G Secret Flawless Renewal, Antiperspirant & Deodorant Invisible Solid, Completely Clean 2.6 oz (73g) (2011).

PCT International Search Report in PCT application PCT/EP2013/051731 dated Jun. 7, 2013 with Written Opinion.

* cited by examiner

DUAL-WALLED DISPENSER

This application claims the benefit of U.S. provisional application No. 61/593,165 filed Jan. 31, 2012.

BACKGROUND OF THE INVENTION

This invention relates to a dispenser for the application of solid or semi-solid products, such as, for example, wax sticks, creams, gels and structured emulsions. More particularly, the subject invention relates to dual-walled dispensers for dispensing cosmetic products, including but not limited to antiperspirants, deodorants, lipsticks, and lip balms, in solid or semi-solid form.

BACKGROUND OF THE INVENTION

In many dispensers for the application of solid or semi-solid cosmetic products, in particular, antiperspirant and/or deodorant sticks, there is provided a product-bearing elevator or platform that engages with a threaded screw, the rotation of which moves the platform axially through the barrel to an upper dispensing end from which product is applied. In recent years, dual-walled dispensers in which the product-bearing elevator is contained within an inner barrel or cylinder that, in turn, is contained in an outer shell or jacket, have become increasingly available.

Dual- or double-walled dispensers allow for interesting design features including the possibility of employing translucent or transparent outer shells that allow all or a portion of an inner barrel's colors, graphics, or other visual features to show through the outer shell. The possibility of employing a great many inner barrel/outer shell color combinations significantly expands the potential for customization of branding within the same dispenser configuration.

Where standardizing the dimensions of an inner barrel is of interest, dual-walled dispensers may provide manufacturers with added flexibility in changing the appearance of their packaging, i.e., it may be possible to change the outer shell without having to re-tool the inner barrel. Additionally, dual-walled dispensers provide the potential for an outer shell having more extreme shaping, often desirable from an ergonomic perspective.

Notwithstanding the benefits that they may provide, dual-walled dispensers present several engineering challenges.

A major challenge to fabricators seeking to produce double-walled packs is compensating for dimensional variations, for example, part shrinkage, in a manner that takes into account mating of the inner barrel and outer shell. Dimensional variability may be attributable, in part, to molding conditions and/or tool designs. Part shrinkage issues can be exacerbated by changes to the materials from which dispenser components are molded, such as, for example, changes in color concentrates. Where the same tool is to be used for molding a variety of materials, it is especially critical that the inner barrel/outer shell be configured to provide for part shrinkage and other dimensional variations. Dimensional variations, even when very slight, can result in such components appearing mismatched, interfering with dispenser assembly, and/or impacting functionality and/or visual aesthetics.

To reduce bulk in the assembled dispenser, the inner barrel and/or outer shell of dual-walled packs may have a wall thickness less than that of conventional single-walled packs and, as a result, may be more susceptible to flexing or bending. Additionally, body components of a relatively thin wall thickness can be less resistant to top load fracture or other stresses. Even if individually thinner, joined the strength of such components may be enhanced. Joining the inner barrel and outer shell in a manner that provides acceptable sensory performance, including desirable rotation, can, however, be problematic. Joining of the inner barrel and outer shell is frequently accomplished by the addition of components or pack features, e.g., retention members such as ribs, locks, and the like, that detract from appearance and/or add to assembly cost.

One aspect of this invention is to provide a dual-walled dispense tolerant to dimensional variations, in particular shrinkage of the inner barrel and/or outer shell.

Another aspect of this invention is to provide a robust, double-walled pack having an aesthetically pleasing appearance, wherein the inner barrel and outer shell engage with one another in a manner that resists axial and radial movement that is not otherwise intended, desirably with a minimum number of component parts. Another aspect of this invention is to provide a double-walled dispenser having desirable sensory properties.

These and other aspects of this invention may be achieved by providing a dispenser as hereinafter more particularly described.

SUMMARY OF THE INVENTION

In one embodiment there is provided a dispenser comprising:

A) an inner barrel comprising a tubular sidewall (IBSW) and a bottom wall (IBBW) that together define an interior space (IBIS), wherein the bottom wall of the inner barrel includes an opening (IBO) surrounded by an inner collar that extends upward from such bottom wall (IBBW) into the interior space of the inner barrel and an outer collar that extends downward from the bottom wall of the inner barrel (IBBW), the inner collar and the outer collar each comprising an inner and outer surface; wherein the tubular sidewall of the inner barrel terminates at its upper end in an upper edge (IBSWUE), the tubular sidewall of the inner barrel further comprising an external ridge that is optionally chamfered;

B) an outer shell comprising a tubular side wall (OSSW) and a bottom wall (OSBW) that together define an interior space of the outer shell (OBIS) that holds the inner barrel, the tubular sidewall of the outer shell terminating at its upper end in an upper edge (OSSWUE) that is optionally chamfered;

C) a screw member comprising:
   i) a base comprising:
      a) one or more lugs,
      b) a sealing means, and
      c) a barrel snap; and
   ii) a threaded shaft;

D) a moveable platform; and

E) a control member comprising a tubular sidewall (CMSW) and a top wall (CMTW) that together define an interior space of the control member (CMIS), wherein:

I) the interior space of the outer shell surrounds the inner barrel, with the outer collar of the inner barrel extending outside of the interior space of the outer shell through an opening in the bottom wall of the outer shell; the external ridge of the inner barrel engages with the upper edge of the outer shell; and the inner barrel and outer shell do not move in relation to one another;

II) the screw member engages with the control member such that a portion of the base is contained within the interior space of the control member, and a portion of the base extends through an opening in the top wall of the control member into the inner collar of the inner barrel and engages the sealing means with the inner surface of the inner collar and locks the barrel snap into place above the inner collar; the sealing means and barrel snap being rotatable relative to the inner collar; and III) the outer collar of the inner barrel extends into the interior space of the control member through the opening in the top wall of the control member, and the inner surface of the outer collar cooperates with the lugs of the base of the screw.

DETAILED DESCRIPTION OF THE INVENTION

Figure 3:
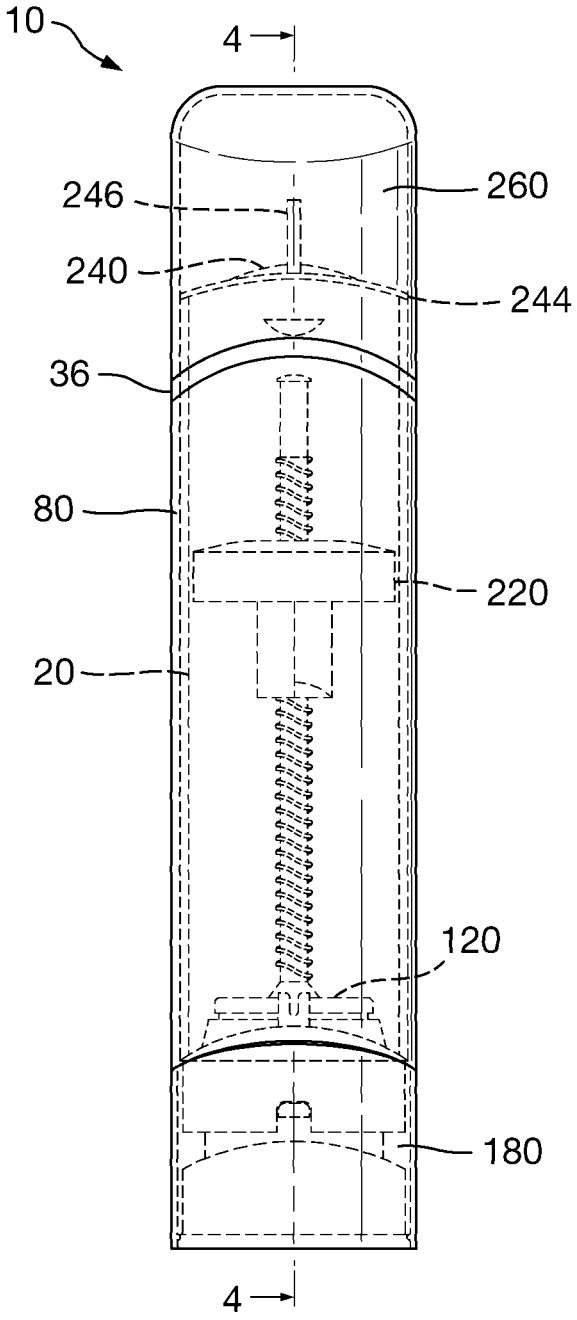
FIG. 3 is side elevation of the dispenser of FIG. 1.
Figure 4:
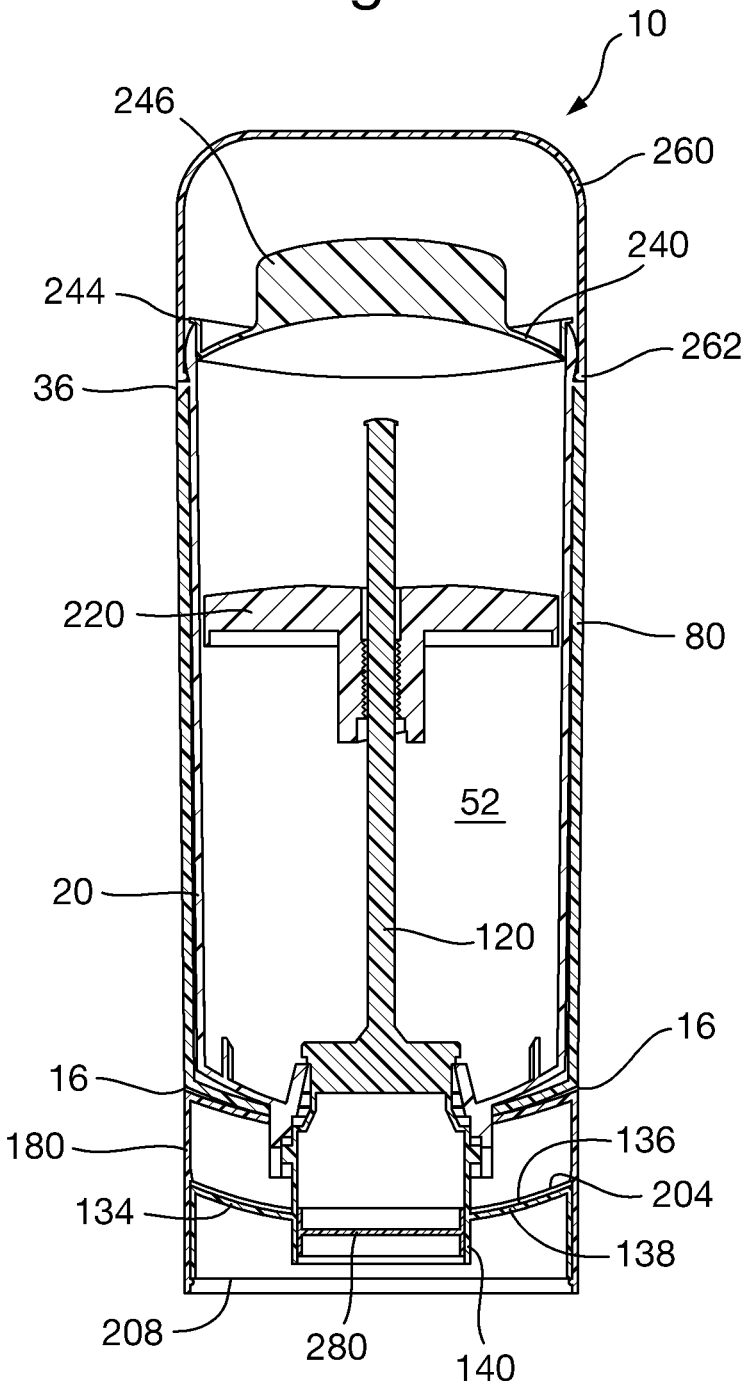
FIG. 4 is a cross section of the dispenser of FIG. 1 viewed along the vertical axis 4-4 shown in FIG. 3.

Except as otherwise indicated, throughout this specification, the terms "upper" and "lower" are used in relation to an orientation in which dispensing end is at the top and base end is at the bottom of the dispenser, which orientation is shown, for example, in FIGS. 3 and 4. More particularly, in relation to positions of components, component features, and component assemblies, "upper" means toward the dispensing end, and "lower" means toward the base end of the dispenser. Other terms of reference such as "above" and "below" are similarly applied with the dispenser in the above described orientation. The terms "downward" and "downwardly" are used interchangeably in relation to a direction that generally extends toward the base end or bottom of the dispenser and the terms "upward" and "upwardly" are used in relation to a direction that generally extends toward the dispensing end of the dispenser. Except as otherwise indicated, in relation to base-, top- and/or sidewalls that define an interior space, the terms "inner surface" and "interior surface" are used interchangeably in relation to a wall surface facing into the interior space and the terms "outer surface" and "external surface" are used interchangeably to refer to an oppositely facing surface of the wall, that is to say, a surface external or exterior to such interior space. In relation to a component or sub-component that has or defines an internal space, for example, the inner barrel, outer shell, collars control member, and, base, the term "outer surface" refers generally to an outside- or exterior surface of such component and the term "inner surface" refers to an inside or interior surface of such component in relation to such internal space.

All numerical range employed in this description ought to be understood as modified by the word "about", as well as to encompass the ranges expressly disclosed. Whether the dispenser of the subject invention or components thereof is described as "including" or "comprising" specific components, narrower embodiments where the dispenser can "consist essentially of" or "consist of" the recited components are also contemplated.

The subject dispenser combines a number of features that together enable the production of a sturdy, double wall dispenser of desirable appearance, including a "premium", clean and/or streamlined look, preferably without any external features that are readily apparent to a user as conventional "locking" components, e.g., external, ribs, snaps, and the like.

Moreover, the dispenser readily accommodates dimensional variations, in particular shrinkage, that typically occur with modifications to the molding conditions and/or material from which a component is made. Moreover, the dispenser lends itself to bottom filling, wherein the product to be contained in the dispenser is introduced in fluid form through the base end of the dispenser.

The dispenser described herein is adaptable to many different sizes. The size of the dispenser depends, in large part, upon the product to be dispensed, the dose at which it is applied, and the dispenser's intended life and/or market placement, e.g., value size, samples, travel size, and the like, with product volumes on the order of 5 ml to 200 ml, more particularly, from 80 ml to 150 ml, being common for many applications. Dispensers having product volumes of 5 ml to 20 ml are contemplated for products dosed in relatively small amounts or travel applications. For many antiperspirant/deodorant applications dispensers having product volumes of 10 ml to 150 m1, more particularly 40 ml to 100 ml, are of particular interest. As will be apparent to one of skill in the art, the volume of the inner barrel will typically be larger than the volume of product, to accommodate components contained therein, component features, and production requirements.

Dispensers having volumes of 80 to 150 ml will typically have a "footprint" or sit on a bottom or base having an area of from 10 $cm^2$ to 40 $cm^2$, more particularly from 15 $cm^2$ to 25

$cm^2$. Within such range of product volumes, larger or smaller footprints are possible depending upon the shape of the dispenser.

The dispenser comprises components that are amenable to being molded, preferably by injection molding, from any of a variety of plastic materials, preferably thermoplastics, including, for example, polyethylene, including high- and low density polyethylene, polypropylene, polyesters such as polyethylene terephthalate (PET), styrene-butadiene copolymers, and the like. Polypropylene and polyethylene are of particular interest. The inner barrel/outer shell structure allows for variations in the materials and material colors in which these and other dispenser components can be made. Optionally, the dispenser may employ one or more transparent or translucent components, with a translucent or transparent outer shell being of interest in one or more embodiments.

The double wall structure of the dispenser arises from the use of an inner barrel and an outer shell each provided as separate components that together form a structure herein referred to as the "body assembly" or "body". The outer shell contains the inner barrel which, in turn, contains the platform and, when the dispenser is filled, the product to be dispensed. The inner barrel and outer shell each comprise a tubular sidewall and a bottom wall. Together, the tubular sidewall and the bottom wall define the interior space of the body component comprising same. In each of these body components there is an opening or hole in the bottom wall, preferably in the center of the bottom wall, with such openings desirably being aligned when the inner barrel is engaged with the outer shell. To allow for dimensional variations, it may be desirable for there to be a slight gap between the bottom wall of inner body and the bottom wall of the outer shell.

The tubular sidewalls can be configured to any of a variety of different cross sectional areas, e.g., circular, square, elliptical, and the like. In one or more embodiments, cross sectional areas that are generally oval or elliptical are of particular interest. Circular inner barrel cross sectional configurations can give rise to additional design considerations, given the potential rotational movement of the platform. When the platform has a cross-sectional configuration in the region of the platform rim that generally conforms to that of the inner barrel that it transverses. The inclusion of internal guide means or other changes to the inner surface of the inner barrel and changes to the cross-sectional configuration of the platform are among the many different design options available to engineers seeking to accommodate same and to prevent platform rotation within the inner barrel.

In one or more embodiments it is preferred that the cross sectional configuration of the tubular sidewall of the inner barrel conforms generally to that of the outer shell with which it mates, at least with respect to that portion of the inner barrel sidewall that is contained within the outer shell, such that the inner barrel sidewall fits, preferably by a friction fit, within the outer shell sidewall. In one or more embodiments, the outer surface of the inner barrel sidewall and inner surface of the outer shell sidewall generally abut or adjoin one another over a major portion of such surfaces. In one embodiment of particular interest, it is desirable that any gap between the sidewall of the inner barrel and the sidewall of the outer shell is less than 2 mm, and preferably is less than 1 mm.

The invention also contemplates embodiments where a portion of the cross sectional configuration of the tubular sidewall of the outer shell departs from that of the inner barrel to provide a body with a more extreme appearance, for example, waisting, bulges and the like.

The thickness of the tubular sidewalls of the dispenser body can vary, that is to say, the inner barrel and outer shell may be thinner or thicker in different regions of their respective sidewalls. Sidewall thickness depends, in part, on the size and shape of the dispenser, the engineering criteria of the dispenser, including the stress forces that a sidewall or sidewall region is engineered to withstand, the material from which the component comprising same is fabricated, and the design of the molds from which such components are made. From a material cost and environmental perspective, it is desirable to minimize wall thickness. From a production view, reduced wall thickness may also allow for faster cycle times in molding operations. For many cosmetic applications especially applications where the dispenser has a product volume of from 40 ml to 100 ml, the sidewall of the inner barrel and outer shell are, individually, on the order of from 0.5 mm to 8 mm thick, more particularly, from 0.5 mm to 6 mm thick with the combined sidewall thickness of such components being on the order of from 1 mm to 10 mm, more particularly, from 2 to 8 mm and, in at least one embodiment, from 2 to 5 mm. In one or more embodiments it is desirable to reduce the sidewall thickness of at least one such component to 0.5 to 4 mm.

At the dispensing end, the tubular sidewall of the inner barrel and outer shell each terminate in an upper edge. With respect to the inner barrel and outer shell sidewalls, the distance from the upper end of the sidewall to the lower end of the sidewall may optionally vary moving around the circumference of such component, giving rise to an upper edge that is higher in some spots than others, for example, the inner barrel may be higher at the side of the dispenser than at the back or front of the dispenser. This allows for flexibility in body design and can allow the upper edge of the inner barrel to be configured such that, toward the end of the dispenser life, it is less likely to come into contact with the surface to which the product is applied. Optionally, the upper edge of the inner barrel and/or the outer shell is beveled or chamfered.

The hole in the bottom wall of the inner barrel is further characterized as being surrounded by an inner collar that extends upward from the bottom wall of the inner barrel into the interior space thereof, and an outer collar that extends downward from the bottom wall of the inner barrel. When the inner barrel is inserted into the outer shell, the outer collar extends through the hole in the bottom wall of the outer shell into the interior space of the control member.

The external surface of the inner barrel includes an external ridge, also referred to as an interface ridge, that extends around the outside circumference of the inner barrel, and in one or more embodiments, is preferably without gaps or gap-like discontinuities therein. When the inner barrel and outer shell are assembled, the upper edge of the outer shell engages with the external ridge forming a connection that desirably is not a rigid one. Put another way, in one or more embodiments it is desirable that the connection formed between the external ridge of the inner barrel and the upper edge of the outer shell is preferably a "floating" one. In one or more embodiments, it is contemplated that neither the external ridge nor the upper edge of the tubular sidewall with which it engages exerts a retention force on the other. It is also contemplated that, in one or more embodiments, no stress is applied between the external ridge and the upper edge of the tubular sidewall of the outer shell when engaged.

The connection between the external ridge of the inner barrel and upper edge of the sidewall of the outer shell is such that there is sufficient room for the connection to accommodate or "absorb" dimensional variations that result in the inner barrel and/or outer shell being slightly longer or shorter than the standard to which they are designed, for example, as a result of material variations or molding. The connection between the external ridge of the inner barrel and the upper edge of the sidewall of the outer shell desirably builds dimensional tolerance into the subject dispenser. In one or more embodiments of particular interest, excluding the external ridge, no visible locking features are present on the body assembly. In other embodiments of interest, excluding the external ridge, no external locking features are present on the outer surface of the body assembly. In still other embodiments, excluding the external ridge and rotation assembly, no visible locking features are present in the dispenser.

In one or more embodiments it is preferred that the external ridge is configured to allow the upper edge of the outer shell to pass or slide under same without a fastening feature that binds such edge and ridge together. For example, the upper edge of the outer shell may be chamfered, and the external ridge may be provided with a gap or reverse chamfer with which the upper edge of the outer barrel may join or mate.

When a streamlined appearance is desired, it is preferable that the exterior surface of the external ridge is flush with that of the outer barrel. Preferably, the upper edge of the inner barrel is positioned upward of the external ridge to provide space for cap engagement. In one or more embodiments the sidewall of the inner barrel above the external ridge may extend above the side wall of the outer shell for a distance of at least 0.5 mm, more particular, at least 1 mm, with distances of between 0.5 mm and 25 mm, more particularly, between 5 mm and 15 mm, being of particular interest. The outer surface of the inner barrel above the external ridge may include a cap engagement means. Alternative embodiments are contemplated wherein the external ridge itself forms the upper edge of the inner barrel.

The dispenser further includes a screw member, also referred to simply as a screw that comprises a base and threaded shaft. The threaded shaft engages with the platform, and the base engages with the control member. The threaded shaft extends into the interior space of the inner barrel for a substantial length of the sidewall forming a vertical axis that the platform travels as it is advanced or retracted. In one or more embodiments it is contemplated that the base and threaded shaft form a single integral molding, however embodiments wherein the threaded shaft is molded separately from the base are also envisioned. By separately molding the threaded shaft and the base it is possible to facilitate the engagement of the threaded shaft with the platform outside of the dispenser body, potentially shortening the assembly process.

The base includes a sealing means that engages with the inner surface of the inner barrel and, a barrel snap that is locked into place when the inner body, base and control member are assembled. The sealing means and barrel snap are able to be rotated relative to the inner collar. The sealing means is engages the base with the inner surface of the inner collar. The sealing means is desirably flexible, so as to allow the section of the base containing same to be fitted into the inner collar and to engage with the inner surface thereof in a manner that allows for relative rotation between the screw and the body assembly. The sealing means should also be sufficiently unyielding in the assembled state that a desirable seal with the inner surface of the inner collar is provided.

The configuration of the sealing member is impacted by features that include the area of contact, the strength of the torsional forces applied during rotation, and the frictional force between the sealing member and the inner surface of the inner collar. Accounting for such factors may be readily taken into account by a packaging engineer in configuring an appropriate sealing means. In one or more embodiments, the sealing means may take the form of one or more annular beads or, more preferably, one or more annular fins or blades.

To perform the locking function described above, the barrel snap is preferably configured as a ledge or impedance that clears and snaps into place above the upper edge of the inner collar in the course of assembly of the rotation member and body. Thus, the portion of the base containing the barrel snap needs to be able to pass through the both the outer- and inner collars in order to secure the engagement of the barrel snap. Once the barrel snap is engaged, it should resist being pulled back through the inner barrel, i.e., the lock provided by the barrel snap is "permanent", as is the resulting engagement of the body, base and control member.

To minimize gaps between the control member and body assembly, the connection provided by the rotation assembly and the body assembly should be such that the barrel snap extends beyond the upper rim of the inner collar, with the body assembly being locked to the rotation assembly by the cooperative action of the barrel snap, inner collar, base and control member. That is to say, the rotation assembly resists being disengaged from the body assembly owing to the barrel snap hindering it from moving downward, The outer- and inner collars are typically of a generally circular configuration. The outer collar should be sufficiently rigid to maintain control of the sensory profile, and typically is more rigid than the inner collar. At its largest diameter, the barrel snap is typically wider than the inner diameter of the opening or hole defined by the upper edge or rim of the inner collar. To aid in assembly, the inner diameter of the opening or hole defined by the outer collar may be larger than the largest diameter of the barrel snap. The inner collar is preferably sufficiently flexible that, in the course of assembly, the barrel snap can pass through and click or snap into place above same. The inner collar may be tapered such that the opening defined by its upper edge is narrower than the opening at the base of the inner collar, thereby minimizing the force required to engage the barrel snap. The inner collar should not be so tall or so long that rotation of the control member is impeded, as a taller collar may increase the surface over which friction is encountered. Conversely, the inner collar should not be so short that it negatively impacts the gap between the rotation member and the dispenser body.

The base further includes one or more lugs that transverse the inner surface of the outer collar and, by their interaction with the outer collar, contribute to the sensory characteristics or "feel" of the dispenser as the control member, and hence the screw, is rotated or turned. More particularly, changes in the distance between the lug and the inner surface of the outer wall can contribute to a greater or lesser force being required to turn the control member in relation to the dispenser body. By slightly changing the cross sectional configuration of the collar such that the distance between the lug and the interior surface of the outer wall changes when the control member is rotated, one can alter the force needed to turn the control member in the course of such rotation. In one or more embodiments, the lugs may aid a user in finding a "home" position of alignment between the control member and dispenser body. Additionally, the dispenser may be configured such that the lugs provide an audible and/or sensory signal of incremental dose. When more than one lug is present, it is typically preferred that the lugs align on the same horizontal plane of the base.

In one or more embodiments the base is configured to include a shoulder and skirt. Typically, the sealing means, snap fit and lugs are positioned on the shoulder with the sealing means being positioned upward of the lugs and the barrel snap being positioned upward of the sealing means.

The skirt comprises a top wall and tubular sidewall that together define the interior space of the skirt.

As noted above, in one or more embodiments it is desirable that the dispenser is capable of being bottom filled. For bottom filling to occur, the base needs to provide an opening for filling that extends into the inner barrel and terminates in a filling aperture that opens into the inner barrel. Typically filling takes place from a nozzle or fluid injection point positioned outside of the dispenser. Bottom filling is desirably carried out with the dispenser in an invert position, with dispensing end closed by a dome former, and the platform in position proximate to the bottom wall of the inner barrel. Product is introduced in fluid form, with the dispenser being held in an invert position for a period sufficient to solidify, structure or gel the fluid, optionally under conditions to accelerate same. Bottom filling takes place with the inner barrel, outer shell, screw member, control member, dome former and, optionally, cap having been assembled. In some filling processes, the dome former may be replaced by a puck that is employed in production and removed after the product has solidified, allowing the dome former to be eliminated as a dispenser component, as the dome former, when present, is generally discarded upon the first use of the dispenser.

To aid in filling, as well as to provide a site for fitting a plug or closure after filling, the skirt preferably includes a downwardly depending chimney or collar that surrounds a hole in the top wall of the skirt. Above the top wall of the skirt, the chimney is surrounded by the shoulder, which is typically of a generally tubular configuration and opens into the interior space of the inner barrel through the filling aperture.

The subject invention also contemplates embodiments where the dispenser can be top filled.

The screw member engages with the control member to form an assembly referred to as the rotation assembly. Forming the control member as separate components allows for more extreme shaping of the control member. In some configurations, however, it may be possible to mold the rotation assembly as a single, integral component.

The control member comprises a top wall and tubular sidewall that define the interior space of the control member. A portion of the base fits within the control member and a portion of the base extends outside of the control member. The portion of the base that fits within the control member includes the lugs, and the portion of the base that extends outside of the control member includes the sealing means and barrel snap. To provide a desirable aesthetics, the top wall of the control member is typically configured to match, preferably relatively closely, the curvature, if any, of the bottom wall. As the rotation member is turned, such top/bottom wall curvatures can give rise to impedances that contribute to the sensory profile of the dispenser.

When the rotation assembly and the body assembly are connected and aligned, i.e., the control member is in the home position, desirably there is a very slight gap between the top wall of the control member and the bottom wall of the outer shell. This gap aids in rotation and impacts the tightness of the fit between the rotation assembly and the body assembly. In many applications, such gap preferably does not exceed 3 mm, and more preferably does not exceed 2 mm.

The platform engages with the threaded shaft and serves as a carrier for product contained in the dispenser. The platform may be configured for bottom filling, top filling or to hold a product-containing cartridge. Thus, the intended application largely dictates the platform's configuration. For antiperspirant/deodorant compositions in the form of solid sticks, it is generally desirable that the dispenser be amenable to bottom filling. In bottom filled dispensers, the platform comprises a plurality of openings, often defined by a skeletal structure that comprises a plurality of upstanding walls. Typically the platform comprises a dm that may be continuous or intermittent, which rim contacts or is positioned slightly inward of the inner surface of the sidewall of the inner barrel creating a gap into which product can flow and solidify. The frictional force created by a gap filled with product aids in providing smoother axial movement of the product-bearing platform along the vertical axis of the dispenser. The platform should provide for desirable product engagement, typically by maximizing the available surface for product contact, while minimizing the amount of unused product that remains in the dispenser at the end of pack life. One platform of particular interest for bottom-filled applications is described in PCT/EP2009/067504, incorporated herein by reference.

The subject dispenser preferably provides a propel-repel action of the platform, i.e., the platform may be moved up or down depending upon the direction in which the control member is turned.

While the upper end of the to inner barrel is generally "open" when the product to be dispensed is a solid stick or other relatively rigid material, when the product to be dispensed is a softer material, it is generally desirable to include an applicator head having a plurality of openings or slots through which such product can be dispensed. In such a case, the platform may need to be modified to accommodate the softer product.

In one method of assembly, the body is formed by inserting the inner barrel into the outer shell such that the outer collar of the inner barrel extends out of the opening in the bottom wall of the outer shell; the rotation member is separately formed by inserting the screw into control member such that the base engages with the control member and the threaded shaft passes through the opening in the control member's top wall. The platform is dropped into the body and held into position while the threaded shaft is passed into the bottom collar and, without locking the rotation assembly to the body, the control member is turned to engage the platform shaft and move it down the shaft to the base of the screw. Once the platform is close to the bottom end of the threaded shaft, the base may be pushed up into the inner collar such that the barrel snap clicks into place above the upper edge of the inner collar. The platform may then be brought into its stop position atop the platform stop. The dome former, if present, followed by the cap may then be mounted on the dispensing end of the dispenser.

Non-limiting embodiments of the subject dispenser and/or components thereof are described in further detail with reference to the appended Figures which are furnished by way of illustration only and should not be construed as limiting the subject invention to the embodiments so depicted.

As illustrated in FIGS. 1 to 4, dispenser 10 includes inner barrel 20, outer shell 80, screw member 120, control member 180, and platform 220. Together, inner barrel 20 and outer shell 80 form body 12, shown in unassembled form in FIG. 1. As shown in greater detail in FIG. 7D, screw member 120 includes base 130 and threaded shaft 168, threaded shaft 168 being shown in engagement with platform 220 in FIGS. 3 and 4.

Figure 1:
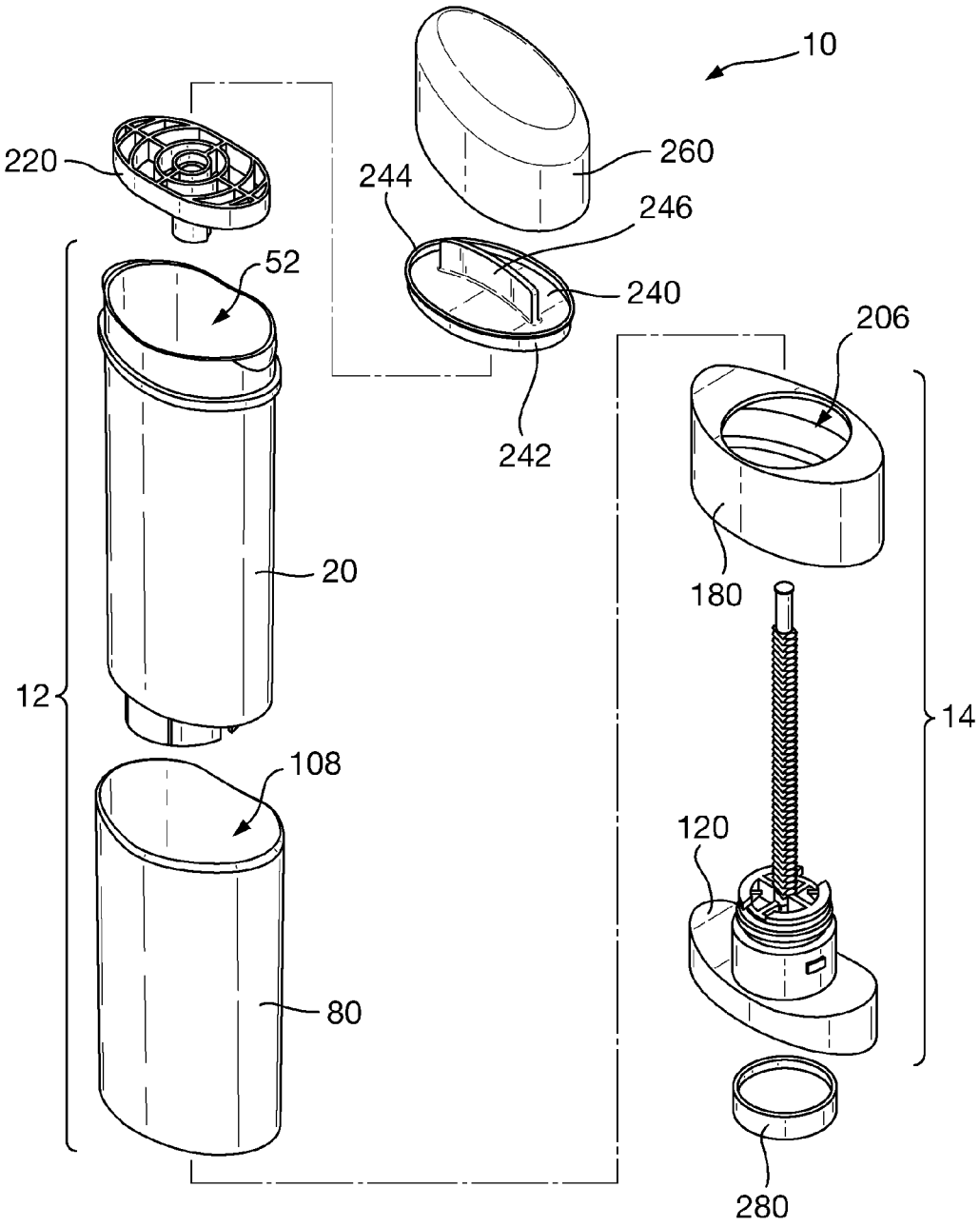
FIG. 1 is an exploded perspective view of a dispenser according to this invention, having a form suitable for bottom filling.
Figure 2:
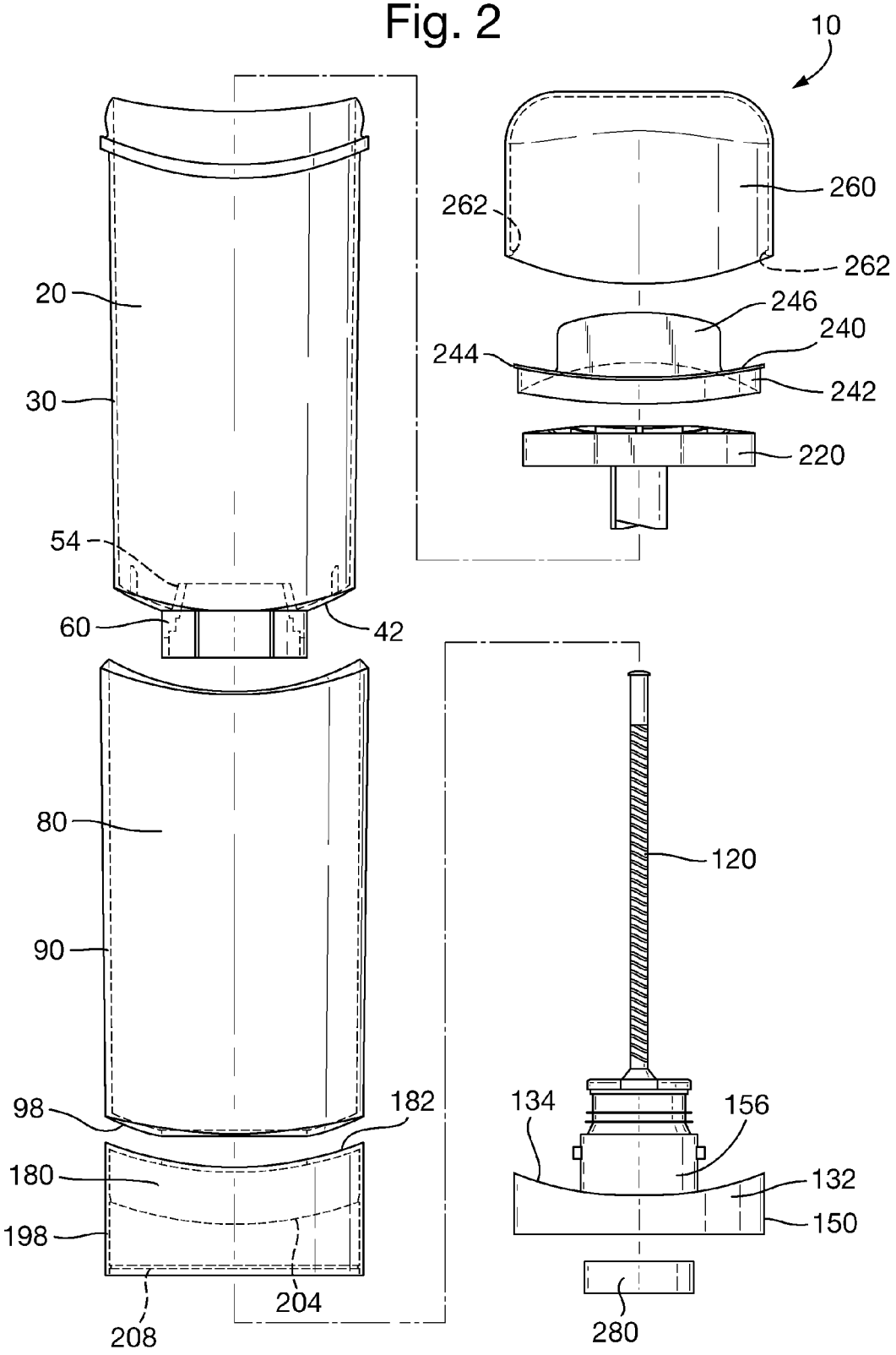
FIG. 2 is an exploded front elevation of the dispenser of FIG. 1, with some components being shown in clear view.

Dispenser 10 is shown with dome former 240 which, in FIGS. 3 and 4, is mounted on dispensing end 26 of inner barrel 20. As shown in one or more of FIGS. 1 to 4, dome former 240 includes sealing face 242 that adjoins inner surface 32 of side wall 30 of inner barrel 20 at dispensing end 26. Dome former 240 is also shown to include sealing rim 244 that engages with edge 40 of inner barrel 20, and grip 246. Cap 260 is shown in FIGS. 3 and 4 mounted on dispensing end 26 of inner barrel 20. As depicted in FIGS. 2 and 4, cap includes projections 262 which, in the assembled dispenser, are engaged with cap snaps 38.

Figure 5A:
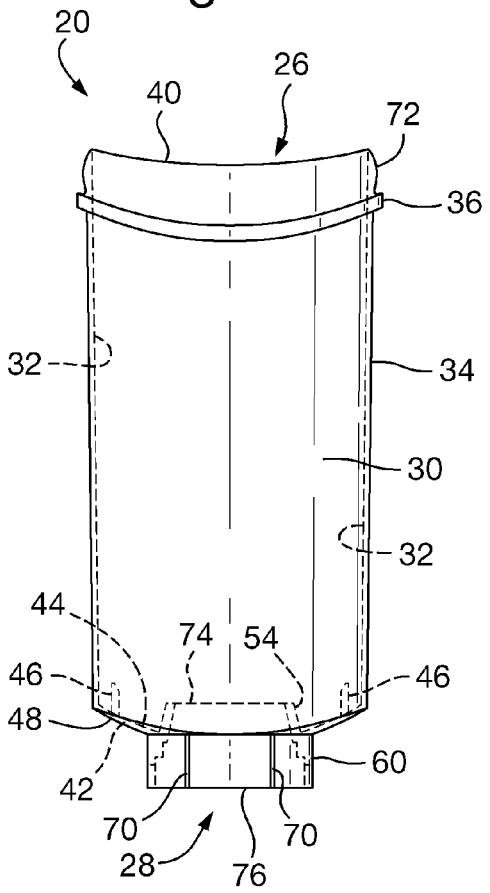
FIG. 5A is a front, clear elevation of the inner barrel shown in the dispenser of FIG. 1.
Figure 5B:
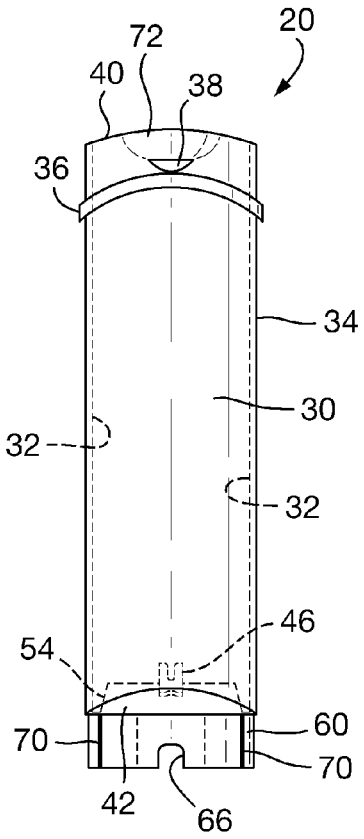
FIG. 5B is a side, clear elevation of the inner barrel shown in the dispenser of FIG. 1.

Outer shell 80 of dispenser 10 is shown in further detail in FIGS. 5A through 5D. Inner barrel 20 includes tubular sidewall 30 and bottom wall 42. Tubular sidewall 30 extends between dispensing end 26 and bottom end 28 of inner barrel 20. Together, tubular sidewall 30 and bottom wall 42 define interior space 52 of inner barrel 20. Sidewall 30 has an inner surface 32 and outer surface 34; and bottom wall 42 has an inner surface 44 and an outer surface 48. External ridge 36 extends from outer surface 34 of sidewall 30 at a location proximate dispensing end 26 of inner barrel 20. As illustrated in FIG. 5B, cap snap 38 is included on inner barrel 20 and is depicted in FIG. 3 on outer surface 48 in a position upward of external ridge 36. A pair of platform supports 46 extends upward from inner surface 44 of bottom wall 42. At dispensing end 26, sidewall 30 terminates in upper edge 40. A slight outward curving of sidewall 30 between external ridge 36 and upper edge 40 forms comfort top 72 As shown, sidewall 30 has a cross sectional configuration that is generally elliptical.

Figure 5C:
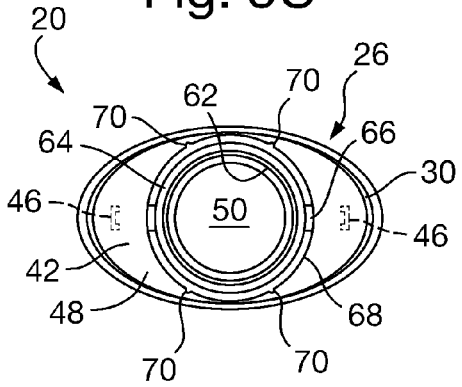
FIG. 5C is a top plan view of the bottom of the inner barrel shown in the dispenser of FIG. 1.
Figure 5D:
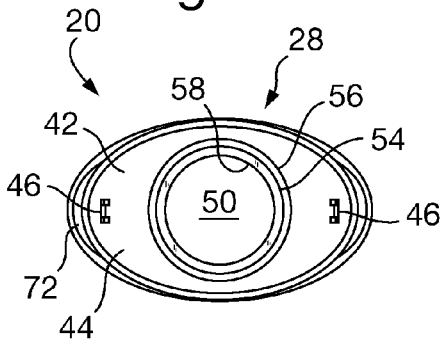
FIG. 5D is bottom plan view of the inner barrel shown in the dispenser of FIG. 1.

Bottom wall 42 includes opening or hole 50. Opening 50 is surrounded by outer collar 60 that extends downward from outer surface 48 of bottom wall 42. Opening 50 is surrounded by inner collar 54 that extends upward from inner surface 44 of bottom wall 42 into interior space 52 of inner barrel 10. Inner collar 54 has an inner surface 58 and an outer surface 56; outer collar 60 has an inner surface 62 and an outer surface 68. As shown in FIGS. 5A and 5B, inner collar 54 tapers to a smaller inner diameter at its upper edge 74, which diameter is shorter than the inner diameter of outer collar 60 at its lower edge 76. A plurality of splines 70 are positioned on outer surface 68 of outer collar 60. Inner rim 64 extends inward from inner surface 62 of outer collar 60. As illustrated in FIGS. 5B and 5C, outer collar 60 includes a pair of notches or slots 66. Apart from opening 50, bottom wall 42 seals off bottom end 28 of inner barrel 20.

Figure 6A:
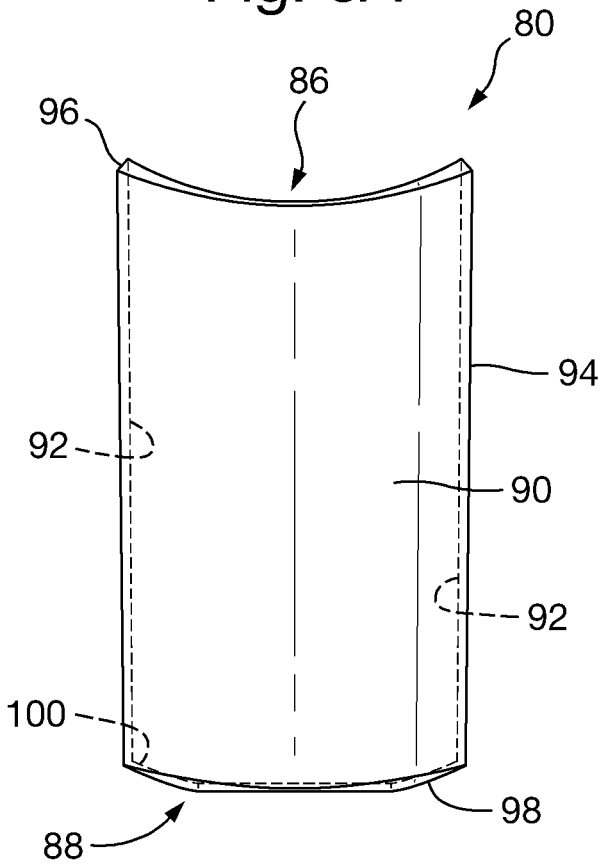
FIG. 6A is a front, clear elevation of the outer shell shown in the dispenser of FIG. 1.
Figure 6B:
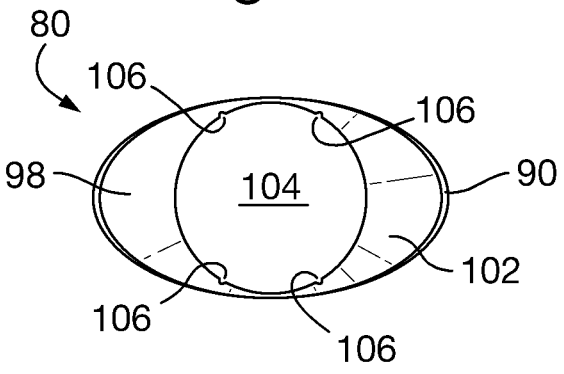
FIG. 6B is a top plan view of the outer shell shown in the dispenser of FIG. 1.

Outer shell 80 of dispenser 10 is shown in greater detail in FIGS. 6A and 6B. Outer shell 80 includes tubular sidewall 90 and bottom wall 98. Tubular sidewall 90 extends between top end 86 and bottom end 88 of outer shell 80. Together, tubular sidewall 90 and bottom wall 98 define interior space 108 of outer shell 80. Sidewall 90 has an inner surface 92 and an outer surface 94, and bottom wall 98 has an inner surface 100 and an outer surface 102. At top end 86, sidewall 90 terminates in upper edge 96, shown in FIG. 6A as chamfered. As shown in FIG. 4, upper edge 96 is engaged with external ridge 36 of inner barrel 20. Sidewall 90 is shown as having a cross section that is generally elliptical. As illustrated in one or more of FIGS. 1 to 4, outer surface 94 of sidewall 90 of outer shell 80 generally follows, i.e., conforms to, the contour of the inner surface 34 of sidewall 30 of inner barrel 20. As depicted in FIG. 4, in assembled dispenser 10 there is a slight gap 16 between bottom wall 42 of inner barrel 20 and bottom wall 98 of outer shell 80.

As illustrated in FIG. 6B, bottom wall 98 includes an opening or hole 104 having a plurality of indents 106 along the periphery thereof. Apart from opening 104, bottom wall 98 seals off bottom end 88 of outer shell 80. As shown in assembled dispenser 10 of FIGS. 3 and 4, outer collar 60 of inner barrel 20 extends through opening 104 of bottom wall 98 of outer shell 80 and splines 70 of outer collar 60 align with indents 106 of opening 104.

Screw member 120 is shown in further detail in FIGS. 7A through 7D. Screw member 120 includes base 130 that includes a skirt 132 and shoulder 156. The skirt 132 includes sidewall 150 and top wall 134. Top wall 134 has an upper surface 136 and a lower surface 138, and further includes opening or hole 142. As shown in FIG. 4, fill collar 140 surrounds opening 142 and extends downward from top wall 134. Fill collar 140 is closed by the insertion of plug 280.

Figure 7A:
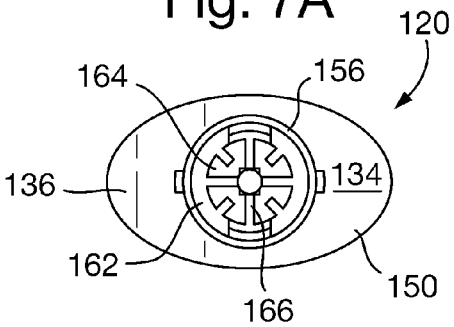
FIG. 7A is a top plan view of the screw member shown in the dispenser of FIG. 1.
Figure 7B:
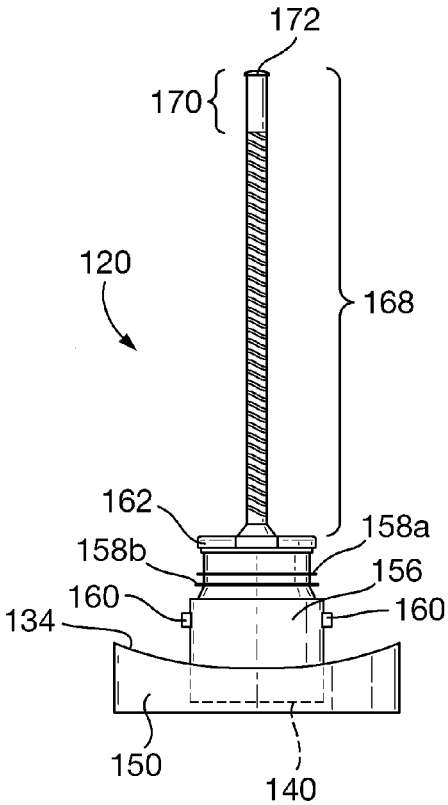
FIG. 7B is a front elevation of the screw member shown in the dispenser of FIG. 1.
Figure 7C:
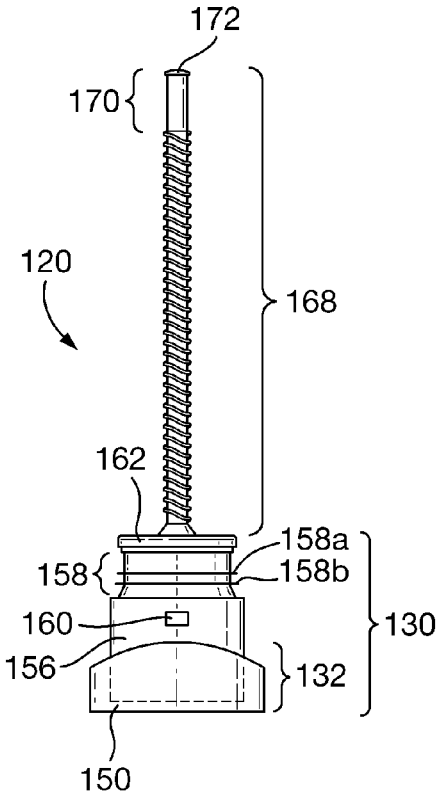
FIG. 7C is a side elevation of the screw member shown in the dispenser of FIG. 1.
Figure 7D:
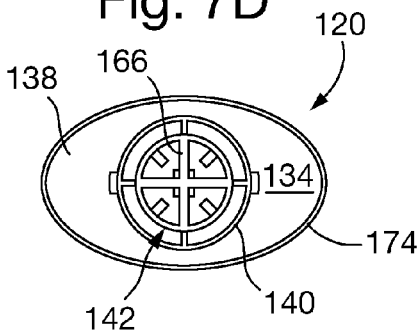
FIG. 7D is bottom plan view of the screw member shown in the dispenser of FIG. 1.

Shoulder 156 extends upward of opening 142 in top wall 134 of skirt 132. As illustrated, shoulder 156 includes a pair of lugs 160. Upon rotation of control member 180, lugs 160 traverse inner rim 64 of outer collar 60, moving in and out of slots 66 and, as they do so, altering the torque needed to rotate the control member. Sealing means 158 includes a pair of flexible annular fins 158*a* and 158*b*, positioned above lugs 160. Shoulder 156 includes barrel snap 162. Shoulder 156 includes filling aperture 164 by connecting spars 166. As shown in FIG. 7A, spars 166 mount threaded shaft 168 on the base 130. The underside of spars 166 is depicted in FIG. 7D, which also depicts bottom edge 174 of sidewall 150 of skirt 132. Threaded shaft 168 includes anti-fallout section 170 and screw tip 172.

Figure 8A:
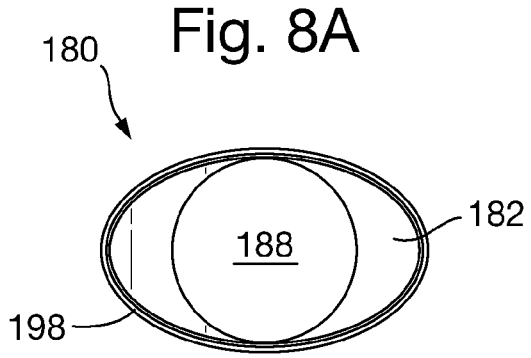
FIG. 8A is a top plan view of the control member shown in the dispenser of FIG. 1.
Figure 8B:
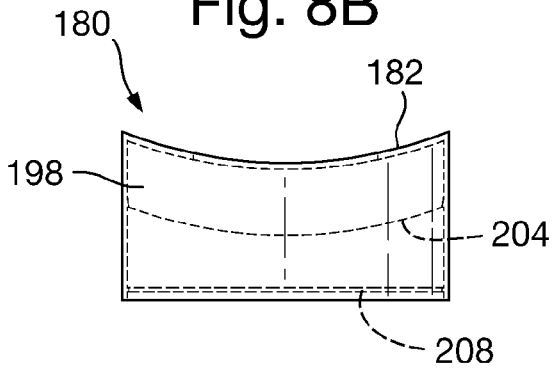
FIG. 8*b* is a front elevation of the control member shown in the dispenser of FIG. 1.
Figure 8C:
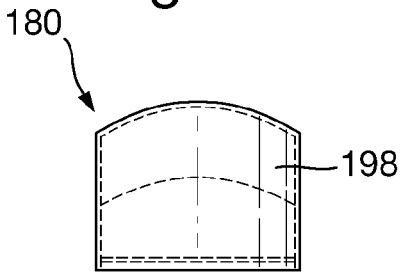
FIG. 8C is a side elevation of the control member shown in the dispenser of FIG. 1.
Figure 8D:
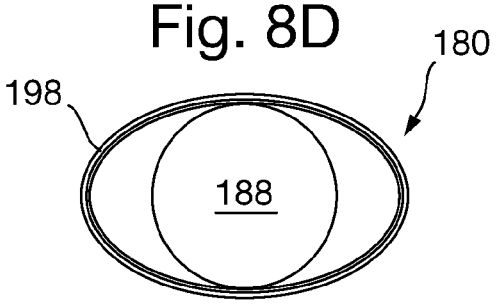
FIG. 8D is a bottom plan view of the control member shown in the dispenser of FIG. 1.

Control member 180 is shown in further detail in FIGS. 8A to 8D. Control member 180 includes top wall 182 and sidewall 198 which together define interior space 206. Top wall 182 further includes opening or hole 188. Screw member 120 and control member 180 form rotation assembly 14, shown unassembled in FIG. 1, that engages with body 12. As shown in FIG. 8B, control member 180 includes stop ledge 204 and bead stop 208. FIG. 4 shows stop ledge 204 engaged with top wall 134 of skirt 132 and bead stop 208 engaged with bottom edge 174 of sidewall 150 of skirt 132.

Figure 9A:
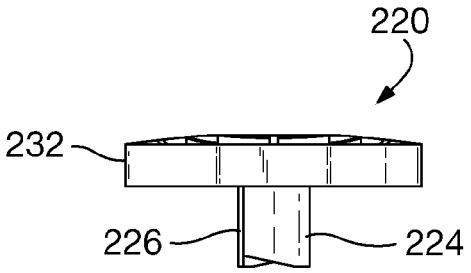
FIG. 9A is a front elevation of the platform shown in the dispenser of FIG. 1.
Figure 9B:
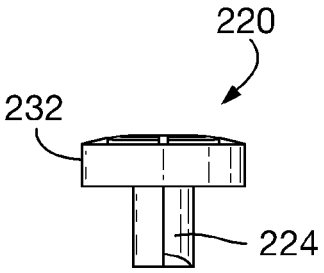
FIG. 9B is a side elevation of the platform shown in the dispenser of FIG. 1.
Figure 9C:
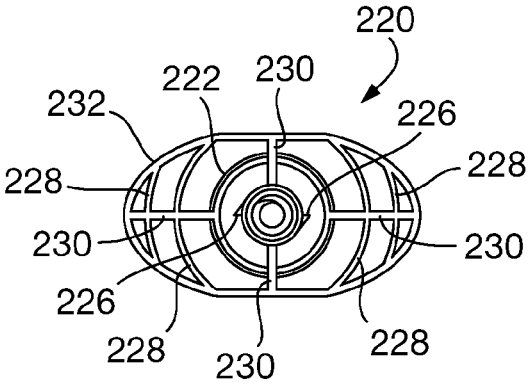
FIG. 9C is a bottom plan view of the platform shown in the dispenser of FIG. 1.

Platform 220 is illustrated in further detail in FIGS. 9A to 9C. As illustrated, platform 220 includes shaft 224 having a pair of back-wind stops 226. As illustrated in the assembled dispenser, shaft 224 is engaged with threaded shaft 168. Filling ring 222, curved walls 228 and partitions 230 provide platform 220 with a skeletal structure for retaining product (not shown). Platform 220 further includes rim 232.

What is claimed is:

1. A dispenser comprising:

A) an inner barrel comprising a tubular sidewall and a bottom wall that together define an interior space of the inner barrel, wherein the bottom wall of the inner barrel includes an opening surrounded by an inner collar that extends upward from said bottom wall into the interior space of the inner barrel and an outer collar that extends downward from the bottom wall of the inner barrel, the inner collar and the outer collar each comprising an inner and outer surface; wherein the tubular sidewall of the inner barrel has an upper end that terminates in an upper edge, the tubular sidewall of the inner barrel further comprising an external ridge that is optionally chamfered;

B) an outer shell comprising a tubular sidewall and a bottom wall that together define an interior space of the outer shell that holds the inner barrel, wherein the tubular sidewall of the outer shell has an upper end terminating in an upper edge that is optionally chamfered;

C) a screw member comprising:

i) a base comprising:

a) one or more lugs, b) a sealing means, and c) a barrel snap; and ii) a threaded shaft;

D) a moveable platform; and

E) a control member comprising a tubular sidewall and a top wall that together define an interior space of the control member, wherein:

i. the interior space of the outer shell surrounds the inner barrel, with the outer collar of the inner barrel extending outside of the interior space of the outer shell through an opening in the bottom wall of the outer shell; the external ridge of the inner barrel engages with the upper edge of the outer shell; and the inner barrel and outer shell do not move in relation to one another;

ii. the screw member engages with the control member such that a portion of the base is contained within the interior space of the control member, and a portion of the base extends through an opening in the top wall of the control member into the inner collar of the inner barrel and engages the sealing means with the inner surface of the inner collar and locks the barrel snap into place above the inner collar; the sealing means and barrel snap being rotatable relative to the inner collar;

iii the outer collar of the inner barrel extends into the interior space of the control member through the opening in the top wall of the control member such that the outer collar cooperates with the lugs of the base of the screw;

iv at least a portion of the tubular sidewall of the inner barrel extends above the interior space of the outer shell; and v. the upper edge of the inner barrel is positioned upward of the external ridge.

2. The dispenser of claim 1 wherein the base further comprises a filling aperture that opens into the interior of the inner barrel.

3. The dispenser of claim 1 that is capable of being bottom filled.

4. The dispenser of claim 1 wherein the collars of the inner barrel each define inner diameters, with the outer collar having an inner diameter that is larger than that of the inner collar where the inner collar opens into the interior space of the inner barrel.

5. The dispenser of claim 1 wherein the external ridge is flush with the outer surface of the outer shell where the external ridge and outer shell engage.

6. The dispenser of claim 1 wherein, when engaged, there is no applied stress between the external ridge and the upper edge of the tubular sidewall of the outer shell.

7. The dispenser of claim 1 wherein the inner barrel and outer shell form an assembly in which, excluding the external ridge, no visible locking features are present.

8. The dispenser of claim 1 wherein the outer collar further comprises at least one notch with which the lugs move in and out of engagement as the control member is turned.

9. The dispenser of claim 1 wherein excluding the outer collar, the bottom wall of the inner barrel is wholly contained within the interior space of the outer shell.

10. The dispenser of claim 1 wherein the tubular sidewall of the inner barrel fits by a friction fit within the tubular sidewall of the outer shell.

11. The dispenser of claim 1 wherein the bottom wall of the outer shell and the top wall of the control member have curvatures that are configured to match one another.

12. The dispenser of claim 1 wherein any gap between the tubular sidewall of the inner barrel and the tubular sidewall of the outer shell is less than 1 mm.

13. The dispenser of claim 1 wherein neither the external ridge nor the upper edge of the tubular sidewall of the outer shell with which the external ridge engages exert a rentention force on one another.

14. A dispenser comprising:

A) an inner barrel comprising a tubular sidewall and a bottom wall that together define an interior space of the inner barrel, wherein the bottom wall of the inner barrel includes an opening surrounded by an inner collar that extends upward from said bottom wall into the interior space of the inner barrel and an outer collar that extends downward from the bottom wall of the inner barrel, the inner collar and the outer collar each comprising an inner and outer surface; wherein the tubular sidewall of the inner barrel has an upper end that terminates in an upper edge, the tubular sidewall of the inner barrel further comprising an external ridge that is optionally chamfered;

B) an outer shell comprising a tubular sidewall and a bottom wall that together define an interior space of the outer shell that holds the inner barrel, wherein the tubular sidewall of the outer shell has an upper end terminating in an upper edge that is optionally chamfered;

C) a screw member comprising:

i) a base comprising:

a) one or more lugs, b) a sealing means, and c) a barrel snap; and ii) a threaded shaft;

D) a moveable platform; and

E) a control member comprising a tubular sidewall and a top wall that together define an interior space of the control member, wherein:

i. the interior space of the outer shell surrounds the inner barrel, with the outer collar of the inner barrel extending outside of the interior space of the outer shell through an opening in the bottom wall of the outer shell; the external ridge of the inner barrel engages with the upper edge of the outer shell; and the inner barrel and outer shell do not move in relation to one another;

ii. the screw member engages with the control member such that a portion of the base is contained within the interior space of the control member, and a portion of the base extends through an opening in the top wall of the control member into the inner collar of the inner barrel and engages the sealing means with the inner surface of the inner collar and locks the barrel snap into place above the inner collar; the sealing means and barrel snap being rotatable relative to the inner collar;

iii. the portion of the base contained within the interior space of the control member includes the lugs; and iv. the outer collar of the inner barrel extends into the interior space of the control member through the opening in the top wall of the control member such that the outer collar cooperates with the lugs.

15. The dispenser of claim 14 wherein the external ridge and upper edge of the tubular sidewall of the outer shell with which the external ridge engages do not exert a retention force on one another.

16. The dispenser of claim 14 wherein the tubular sidewall of the inner barrel fits by a friction fit within the tubular sidewall of the outer shell.

* * * * *